US012522334B2

(12) United States Patent
Spengler et al.

(10) Patent No.: US 12,522,334 B2
(45) Date of Patent: Jan. 13, 2026

(54) BOAT DRIVE

(71) Applicant: Torqeedo GmbH, Wessling (DE)

(72) Inventors: Anton Spengler, Wessling (DE); Johannes Heller, Wessling (DE); Frank Despineux, Wessling (DE)

(73) Assignee: Torqeedo GmbH, Wessling (DE)

( * ) Notice: Subject to any disclaimer, the term of this patent is extended or adjusted under 35 U.S.C. 154(b) by 490 days.

(21) Appl. No.: 18/145,443

(22) Filed: Dec. 22, 2022

(65) Prior Publication Data

US 2023/0192259 A1 Jun. 22, 2023

(30) Foreign Application Priority Data

Dec. 22, 2021 (DE) ..... 102021134418.2

(51) Int. Cl.
*B63H 20/14* (2006.01)
*B63H 1/22* (2006.01)
*B63H 20/32* (2006.01)

(52) U.S. Cl.
CPC ..... *B63H 20/14* (2013.01); *B63H 1/22* (2013.01); *B63H 20/32* (2013.01)

(58) Field of Classification Search
CPC ..... B63H 20/14; B63H 20/32; B63H 1/22
See application file for complete search history.

(56) References Cited

U.S. PATENT DOCUMENTS 5,011,583 A * 4/1991 Tanbara ..... C23F 13/00 114/221 R
2004/0266277 A1* 12/2004 Ries ..... H02K 3/24 440/6
2021/0006120 A1* 1/2021 Oechslen ..... F16C 35/07
2021/0139124 A1* 5/2021 Culpi ..... B63H 20/32
2021/0391760 A1 12/2021 Pilgrim et al.
2023/0238855 A1* 7/2023 Washino ..... H02K 7/083 310/75 D

FOREIGN PATENT DOCUMENTS

CN 206820580 U 12/2017
CN 109687623 A 4/2019
CN 214506787 U 10/2021
CN 214543912 U 10/2021
CN 214755756 U 11/2021
DE 102010055778 A1 6/2012
DE 102010044436 A1 7/2018
EP 1455434 A1 9/2004
(Continued)

OTHER PUBLICATIONS

Extended European Search Report in EP22215886.7, mailed May 26, 2023, 9 pages.
(Continued)

*Primary Examiner* — Stephen P Avila
(74) *Attorney, Agent, or Firm* — ArentFox Schiff LLP

(57) ABSTRACT

A boat drive is provided for driving a water vehicle. The boat drive includes a drive housing made from a first metallic material and a propeller shaft made from a second metallic material. Moreover, the propeller shaft is designed to receive a drive propeller and the propeller shaft is mounted in the drive housing. In addition, a propeller shaft isolator is provided to electrically isolate the propeller shaft from the drive housing.

15 Claims, 10 Drawing Sheets

(56) References Cited

FOREIGN PATENT DOCUMENTS

| | | | | |
|---|---|---|---|---|
| GB | 1462931 | A | | 1/1977 |
| JP | H1016886 | A | | 1/1998 |
| JP | 2000156952 | A | | 6/2000 |
| JP | 2003220996 | A | * | 8/2003 |
| JP | 2013066252 | A | | 4/2013 |
| WO | 20211073757 | A1 | | 4/2021 |
| WO | 2021164522 | A1 | | 8/2021 |
| WO | 2022044259 | A1 | | 3/2022 |

OTHER PUBLICATIONS

Catalog Torqeedo Germany, Cruise 2.0/4.0, For Boats on Green Lakes, Sailboats and Commercial Users, 2015.
Corrosion Protection, https://www.torqeedo.com/us/en-us/technology-and-environment/corrosion-protection.html, Torqeedo GmbH, 2023.

* cited by examiner

BOAT DRIVE

CROSS-REFERENCE TO RELATED APPLICATION

This application claims priority to German Patent Application No. DE 10 2021 134 418.2 filed on Dec. 22, 2021, the entire contents of which is hereby incorporated in its entirety by reference.

TECHNICAL FIELD

The present invention relates to an electric boat drive for a water vehicle, comprising a drive housing made from a first metallic material and a propeller shaft made from a second metallic material, wherein the propeller shaft is mounted in the drive housing by means of a first shaft bearing and a second shaft bearing. The boat drive can be provided for driving a water vehicle and for example be provided in the form of an outboard engine or a pod drive or an internal engine.

BACKGROUND

The avoidance of galvanic corrosion plays an important role during the design of ship components which come into contact with water in whole or in part, in particular with sea water. Galvanic corrosion constitutes the decomposition of metal due to different galvanic potentials of the different metallic materials when these are submersed in a liquid conductor (electrolyte) together and are short-circuited with each other. Galvanic corrosion can lead to at least one of the metallic materials to decompose and possibly dissolve completely, wherein the metal ions then typically accumulate on the at least one other metallic material.

More precisely, the metal with a lower potential turns into an anode of a galvanic cell, wherein oxidation occurs at the anode. For example, aluminum with a potential of −1.5 volt donates electrons to acceptors (for example oxygen) in seawater via iron with a potential of −0.5 volt. The iron then remains unaffected whilst the anode material aluminum is dissolved.

Water vehicles are therefore often equipped with sacrificial anodes, which provide a metal surface with a lower electric potential than that of the metal that would otherwise be attacked, so that galvanic corrosion is diverted to the sacrificial anode in a targeted way to save the material that is otherwise attacked.

The use of sacrificial anodes does however not always offer complete protection against corrosion. Sacrificial anodes are also cumbersome, especially in small water vehicles, and must also be checked and replaced regularly. Material pairings with different electric potentials are thus often avoided from the start, which can however lead to unnecessarily high-quality and costly materials being used.

SUMMARY OF THE INVENTION

In view of the foregoing, it is an object of the present invention to provide an improved electric boat drive. In an exemplary aspect, the boat drive is provided for driving a water vehicle, and includes a drive housing comprising a first metallic material; a propeller shaft comprising from a second metallic material and being mounted in the drive housing; and a propeller shaft isolator configured to electrically isolate the propeller shaft from the drive housing.

In an exemplary aspect, the boat drive for a water vehicle comprises a drive housing made from a first metallic material and a propeller shaft made from a second metallic material is correspondingly suggested, wherein the propeller shaft is mounted in the drive housing. According to the invention the electric boat drive comprises a propeller shaft isolator, which is designed and equipped for electrically isolating the propeller shaft from the drive housing.

In the sense of the present disclosure, a first metallic material and a second metallic material can be comprised of metallic materials that form a material pairing with different electric potentials. The material pair can be selected in such a way that the electric potential, also called standard potential, between the two is so high that galvanic corrosion, in particular in lake water or sea water, takes place during conductive contact.

The generation of galvanic corrosion basically requires three components, namely an anode, a cathode and an electrolyte as well as an electric connection between anode and cathode.

This construction is typically present when a metallic drive housing and a metallic propeller shaft, which are both submersed in water together, with a conventional boot drive are provided.

By providing the propeller shaft isolator, it is achieved that the electric connection between propeller shaft and drive housing, i.e. between anode and cathode, is interrupted. In other words, the propeller shaft isolator acts in such a way that galvanic corrosion between the propeller shaft and the drive housing is suppressed even if both are submersed in water together, since the electric connection between propeller shaft and drive housing is interrupted.

In other words, the fact that the electric boat drive comprises a propeller shaft isolator that is designed and configured for electrically isolating the propeller shaft from the drive housing means that the metallic material with the lower potential cannot become an anode, as no electric connection with the metallic material with the higher potential exists. To put it differently, the electric insulation or respectively the lack of an electric connection, prevents the formation of an electrochemical gradient that could initiate galvanic corrosion on the metallic material with the lower electric potential.

According to the exemplary aspect, it is considered to not prevent the formation of a galvanic cell on the water side or divert it to a sacrificial anode, but rather to suppress the formation of a galvanic cell on the solid material side in a targeted way. This is realized through the internal isolation of the metallic material with the lower electric potential from the metallic material with the higher electric potential.

This firstly has the advantage that no sacrificial anodes need to be used. It further has the advantage that any material pairings can basically be considered for the drive housing and the propeller shaft, even if the drive housing and the propeller shaft are simultaneously submersed partly or fully in water. As a result, the optimum materials for the propeller shaft and drive housing in terms of mechanical properties, production technology and costs can be used. Costs, weight and manufacturing processes can thus be optimized.

The fact that the propeller shaft isolator is designed and configured to electrically isolate the propeller shaft from the drive housing means that the drive housing can be specifically dimensioned and constructed in such a way that the drive housing can come into contact with water in whole or in part. Ultimately, this allows greater design freedom for the drive housing and any additional housing that may be present, since the drive housing does not need to be shielded against contact with water to prevent corrosion.

According to a preferred further development, the first metallic material includes aluminum, and the second metallic material includes steel. Even though the aluminum/steel material pairing has an electric potential difference of approximately 1 volt, which in principle suffices to initiate galvanic corrosion, such corrosion can be suppressed thanks to the propeller shaft isolator according to the invention.

The fact that the first metallic material includes aluminum means that the drive housing can for example be made of an aluminum alloy. The use of aluminum or an aluminum alloy as a material for the drive housing may reduce manufacturing costs and the overall weight of the electric boat drive. The fact that the second metallic material includes steel means that the propeller shaft may for example be manufactured as a steel alloy. The use of steel or a steel alloy as a material for the propeller shaft means that the same can transmit particularly high torques even with small dimensioning.

According to one advantageous further development the propeller shaft isolator may comprise a plastic, rubber, glass and/or ceramic material. This may ensure an electric isolation characteristic of the propeller shaft isolator. A ceramic material in the sense of the present disclosure can for example comprise aluminum oxide, $Al_2O_3$.

According to one embodiment the propeller shaft may be mounted in the drive housing by means of a first shaft bearing and for example a second shaft bearing. Several shaft bearings can however also be provided.

According to one embodiment of the electric boat drive the first shaft bearing and/or the second shaft bearing may include an internal ring and an external ring, wherein the internal ring and/or or the external ring of the first shaft bearing and/or the second shaft bearing are designed as a propeller shaft isolator.

This embodiment of the electric boat drive may for example comprise shaft bearings designed as slide bearings. The bearings may also be designed as roller bearings according to this embodiment.

By the formulation "designed as a propeller shaft isolator" in the sense of the present disclosure may be meant that in this case the propeller shaft isolator may replace a conventional component and does not necessarily need to exist in the form of an additionally provided object in the electric boat drive. This does however not rule out that the propeller shaft isolator is provided alternatively or in the form of a further component.

The fact that the first shaft bearing and/or the second shaft bearing include an internal ring and an external ring, wherein the internal ring and/or the external ring of the first shaft bearing and/or the second shaft bearing are designed as a propeller shaft isolator, results in a plurality of variants.

In the sense of the present disclosure the electrically conductive contacts between the drive housing and propeller shaft may run solely across the shaft bearings. All variants of the first embodiment example may have in common the advantage that by designing the inner ring and/or outer ring as a propeller shaft insulator, existing electric boat drives can be retrofitted or upgraded. The fact that the internal ring can be in contact with the propeller shaft and the external ring with the drive housing can realize an electric isolation at the contact in question, which may suppress the formation of an electrochemical gradient, the formation of an anode, and consequently the formation of a galvanic cell. Galvanic corrosion of the material with the lower electric potential can thus be prevented. In other words, electrical conduction via the material contact between the propeller shaft and the drive housing can thereby be effectively suppressed.

The internal rings or the external rings of the first and second shaft bearing are preferably designed in such a way that both shaft bearings are designed at least partly as propeller shaft isolators, so that both shaft bearings are of an electrically isolating design. The first shaft bearing and the second shaft bearing do not need to be identical. The first shaft bearing and the second shaft bearing may however be identical.

According to one embodiment of the electric boat drive the first shaft bearing may comprise a first rolling element set and/or the second shaft bearing may comprise a second rolling element set, wherein the first rolling element set and/or the second rolling element set can be designed as a propeller shaft isolator.

A rolling element set in the sense of the present disclosure may be meant as a quantity of rolling elements present in a respective shaft bearing. A rolling element set of the shaft bearing may be present between the external ring and the internal ring of the respective shaft bearing within the meaning of the present disclosure.

The fact that the first rolling element set and/or the second rolling element set are designed as a propeller shaft isolator may achieve electric isolation between the internal ring and the external ring of the shaft bearing in question. Thus, the formation of an electronic gradient, the formation of an anode and the formation of a galvanic cell can be suppressed. Galvanic corrosion of the metallic material with the lower electric potential can therefore be prevented. In other words, electric conduction across the material contact between the propeller shaft and the drive housing can be effectively suppressed. In a preferred further development the roller bearing may also be isolated via an isolator arranged between the external ring of the roller bearing and the drive housing. The isolator then forms the propeller shaft isolator and may for example be designed in the form of a ceramic bushing and/or a plastic bushing for receiving the roller bearing in the drive housing. The propeller shaft isolator can also be designed as a plastic ring or rubber ring, which is arranged between the external ring and the drive housing.

In one preferred further development an isolator can also be arranged additionally or alternatively between the internal ring of the roller bearing and the drive shaft for forming the propeller shaft isolator.

The propeller shaft isolator can also be designed in the form of paper. Paper may for example be arranged between the external ring and/or the internal ring of the roller bearing and the drive housing, forming the propeller shaft isolator in this way.

A propeller shaft isolator can also be formed by an isolating coating. An isolating coating may for example be arranged on the external ring and/or the internal ring of the roller bearing in a bearing seat provided in the drive housing for receiving the roller bearing.

The present disclosure further relates to the fact that an axial bearing can be provided between the propeller shaft and the drive housing, and that a propeller shaft isolator can be formed between the drive housing and the propeller shaft.

According to one embodiment of the electric boat drive the propeller shaft isolator may include a bearing sleeve with a bearing sleeve interior, wherein the bearing sleeve can be designed and configured for installation in the drive housing, and can be designed and equipped to receive at least one of the first shaft bearing and the second shaft bearing in the sleeve interior.

The bearing sleeve may for example be designed and configured in the sense of the present disclosure for installation in the drive housing if it may be secured in the drive housing. The bearing sleeve may also be used in a floating manner. The bearing sleeve may be open on at least one side or have at least one opening. The bearing sleeve may for example be designed and configured in the sense of the present disclosure to receive at least one of the first shaft bearing and the second shaft bearing in the sleeve interior if the at least one shaft bearing in an installed condition does not form an electric contact between the propeller shaft and the drive housing of the shaft bearing and the bearing sleeve. The formation of an electrochemical gradient, the formation of an anode and the formation of a galvanic cell can thus be suppressed. Galvanic corrosion of the material with the lower electric potential may thus be prevented. In other words, electric conduction across the material contact between the propeller shaft and the drive housing can be effectively suppressed.

The fact that the propeller shaft isolator includes a bearing sleeve with a bearing sleeve interior, wherein the bearing sleeve is designed and configured to receive at least one of the first shaft bearing and the second shaft bearing in the sleeve interior, means that the bearing sleeve may also be designed in such a way that it can receive the first shaft bearing as well as the second shaft bearing in the sleeve interior. A propeller shaft including all shaft bearings may therefore be pre-assembled and then installed in the drive housing as a finished assembly. In this way, it can also be achieved that, even if conductive impurities enter between the propeller shaft and the shaft bearing, these cannot lead to an electric contact between the propeller shaft and the drive housing. Ultimately, a particularly high level of safety against an electric contact between propeller shaft and drive housing can be realized in this way. In the sense of the present disclosure, the term bearing sleeve may be understood broadly. Accordingly, the bearing sleeve does not need to take the form of a conventional sleeve, but can for example also partly or completely follow the internal contour of the drive housing. An easier integration of the bearing sleeve into the drive housing may be realized in this way.

According to one embodiment of the electric boat drive, the propeller shaft isolator can include a first bearing sleeve with a first bearing sleeve interior and a second bearing sleeve with a second bearing sleeve interior, wherein the first shaft bearing is received in the first bearing sleeve interior of the first bearing sleeve and wherein the second shaft bearing is received in the second bearing sleeve interior of the second bearing sleeve.

Each shaft bearing can consequently be allocated a dedicated bearing sleeve according to this embodiment. The first bearing sleeve as well as the second bearing sleeve can thus be designed and configured for installation in the drive housing. The formation of an electrochemical gradient, the formation of an anode and the formation of a galvanic cell can thus be suppressed. Galvanic corrosion of the metallic material with the lower electric potential can thus be prevented. In other words, electric conduction across the material contact between the propeller shaft and the drive housing can be effectively suppressed.

According to one embodiment of the electric boat drive the propeller shaft isolator may include a shaft sleeve, which is designed and configured to be arranged in a rotationally rigid manner on the propeller shaft. In the sense of the present disclosure the electric contact between propeller shaft and drive housing may be present at the point of the shaft bearing. The shaft sleeve may be radially arranged between the propeller shaft and the shaft bearing according to the fifth embodiment, so that the propeller shaft isolator is designed and configured to electrically isolate the propeller shaft from the drive housing. In order to fulfil its function expediently, a shaft bearing may be in permanent connection with the adjacent component at the external ring and at the internal ring. Accordingly, it may be necessary to rotationally rigidly connect the shaft sleeve with the propeller shaft. This may for example be realized through interference fitting, by means of splines, by means of a feather key or by means of any other shaft-hub connection.

The fact that the propeller shaft isolator includes a shaft sleeve, which is designed and configured to be rotationally rigidly arranged on the propeller shaft, may suppress the formation of an electrochemical gradient, the formation of an anode and the formation of a galvanic cell. Galvanic corrosion of the metallic material with the lower electric potential can thus be prevented. In other words, electric conduction across the material contact between the propeller shaft and the drive housing can be effectively suppressed.

According to an advantageous further development of this embodiment, the shaft sleeve may include a first shaft sleeve, which is in contact with the first shaft bearing, and a second shaft sleeve, which is in contact with the second shaft bearing. In this way, each shaft bearing may be allocated a dedicated shaft sleeve, which may suppress the formation of an electrochemical gradient, the formation of an anode and the formation of a galvanic cell. Galvanic corrosion of the material with the lower electric potential can thus be prevented. In other words, electric conduction across the material contact between the propeller shaft and the drive housing can be effectively suppressed.

If several shaft bearings are provided, all shaft bearings can be equipped with one of the above-mentioned propeller shaft isolators. It is however also envisaged that some or all of the shaft bearings are each equipped with different propeller shaft isolators.

According to one embodiment, the propeller shaft isolator may be designed as a propeller shaft coating, wherein the propeller shaft coating may be produced by means of spraying, lacquering, vulcanization, adhesion, immersion belt lacquering and/or powder coating. Consequently, electrically non-conductive materials, such as for example thermoplastic natural rubbers, synthetic rubbers, elastomer plastics, but also ceramic particles and/or non-conductive metal oxides may be applied as propeller shaft coatings to the propeller shaft, by which the propeller shaft isolator may be formed. Accordingly, a complete electric isolation of the propeller shaft from the drive housing can be achieved in a simple and safe way, which can suppress the formation of an electrochemical gradient, the formation of an anode and the formation of a galvanic cell. Galvanic corrosion of the metallic material with the lower electric potential can thus be prevented. In other words, electric conduction across the material contact between the propeller shaft and the drive housing may be effectively suppressed. The propeller shaft and/or the inside of the drive housing and/or another component such as the internal ring and/or the external ring of the drive housing and/or other components such as the internal ring and/or the external ring of a bearing and/or a bearing bushing and/or a bearing sleeve may for example be correspondingly equipped with an isolating layer.

According to a preferred further development of this embodiment, the propeller shaft coating can be formed substantially across the entire surface of the propeller shaft. In this way, galvanic corrosion can further be suppressed between the propeller shaft and possible components connected with the propeller shaft, made from a metallic material with an electric potential that differs from that of the metallic material of the propeller shaft.

With one embodiment of the boat drive, where a gearbox received in the drive housing is provided, the drive of which is connected with the propeller shaft or the drive of which forms the propeller shaft, the propeller shaft isolator may also be arranged between the drive of the gearbox and the propeller shaft or in the gearbox. Thereby, the gearbox may also be isolated as a whole from the drive housing and form the propeller shaft isolator. An isolator may for example be arranged between the gearbox, for example a gearbox housing or a gearbox cage, and the drive housing. The isolator then forms the propeller shaft isolator, since it provides the isolation between the propeller shaft and the drive housing. The isolator may for example be a coating, a plastic and/or a rubber isolator and/or a ceramic and/or a paper, as described above. Other types of isolators are also comprised.

Bearings can also be included in the housing in an isolating way, as already described above with regard to the shaft bearings, so as to form the propeller shaft isolator. Individual components of the gearbox may also be designed as isolators, for example gear wheels, worms or bevel wheels, made of plastic and/or ceramic and/or another isolating material, so as to form the propeller shaft isolator.

The embodiments described above with regard to the arrangement of isolators or isolator components can also be used for the components of the gearbox received in the drive housing.

According to a preferred embodiment of the electric boat drive the propeller shaft can further comprise a drive propeller, in particular a foldable drive propeller, wherein the drive propeller can be secured directly to the propeller shaft. The fact that the drive propeller can be secured directly to the propeller shaft means that a gearbox may be omitted and a compact construction of the electric boat drive can be realized. This is advantageous, in particular against the background that the electric boat drive includes a propeller shaft isolator, which is designed and configured for electrically isolating the propeller shaft and the drive housing from each other, as the propeller shaft as well as the drive housing may now be completely, or at least partly simultaneously submersed in water, in particular sea water.

According to a further advantageous development of the boat drive, the propeller shaft isolator can be designed and configured for electrically isolating the propeller shaft from the drive propeller. This can be the case in the sense of the present disclosure if the propeller shaft isolator is realized as a propeller shaft coating and the propeller shaft coating is further formed in the area of the contact between the propeller shaft and the drive propeller. Galvanic corrosion can therefore also be suppressed between the propeller shaft and the drive propeller connected with the propeller shaft, which can include a metallic material with an electric potential that differs from that of the metallic material of the propeller shaft. A complete electric isolation of the propeller shaft from the drive housing and the drive propeller may thus be realized in a simple and safe way, which may suppress the formation of an electrochemical gradient, the formation of an anode and the formation of a galvanic cell between the propeller shaft and the drive housing as well as between the propeller shaft and the drive propeller. Galvanic corrosion of the material with the lower electric potential can thus be prevented. In other words, electric conduction across the material contact between the propeller shaft, the drive propeller and the drive housing can be effectively suppressed.

The problem illustrated above is further solved by an outboard engine in accordance with an exemplary aspect. Advantageous further developments of the outboard engine result from the present description and the Figures.

The outboard engine preferably has a pylon to accommodate the boat drive. A pylon is in particular understood as a housing section of the outboard engine which submersed in water during operation, and preferably has a hydrodynamically optimized outer contour. The drive housing preferably forms completely or partly forms the outer contour of the pylon.

Further advantages and features of the present invention are apparent from the following description of preferred embodiment examples. The features described therein can be realized independently or in combination with one or several of the features set out above, as long as said features do not contradict each other. The following description of preferred embodiments is provided with reference to the enclosed drawings.

BRIEF DESCRIPTION OF THE FIGURES

Preferred further embodiments of the invention will be explained in more detail with reference to the following description of the Figures. Shown are.

DETAILED DESCRIPTION OF EXEMPLARY EMBODIMENTS

Examples of preferred embodiments will be described in the following with reference to the Figures. Identical, similar or identically acting elements will be provided with identical reference numbers in the different Figures, and a repeated description of these elements will be partly omitted in order to avoid redundancies.

Figure 1:
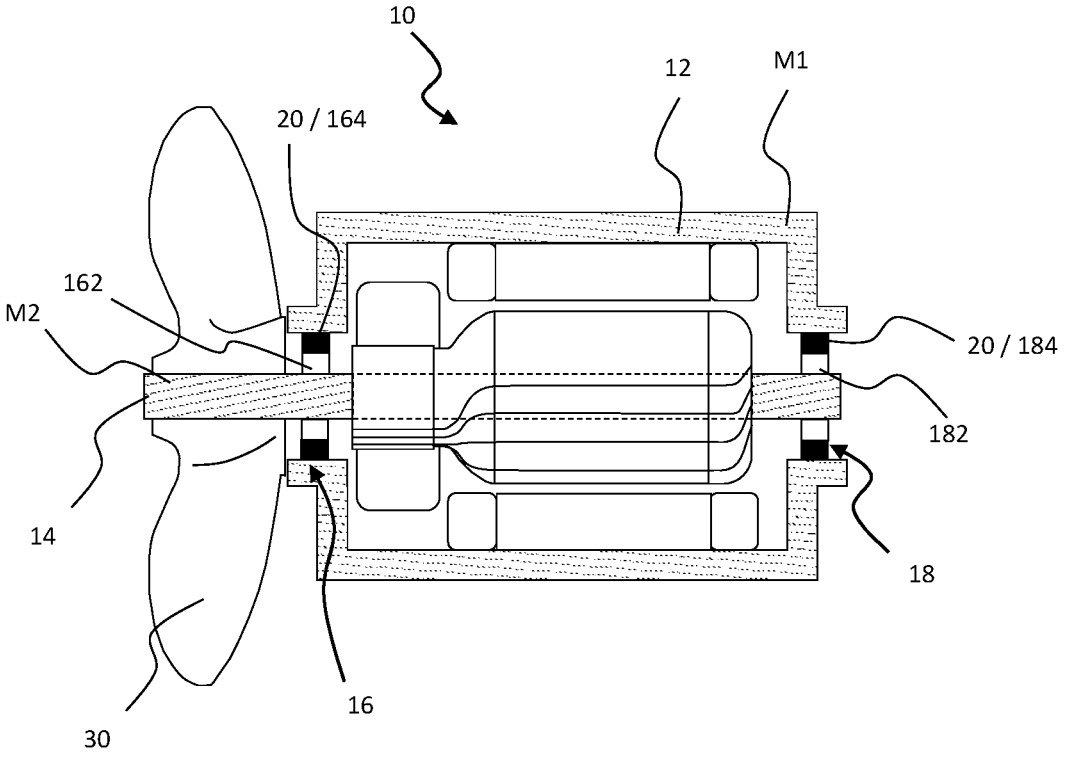
FIG. 1 illustrates a schematic cross-section drawing of an electric boat drive according to a first variant of a first embodiment.

A schematic cross-section drawing of an electric boat drive 10 according to a first variant of a first embodiment example is shown in FIG. 1.

The boat drive 10 for a water vehicle comprises a drive housing 12 made from a first metallic material M1 and a propeller shaft 14 made from a second metallic material M2. The two different metallic materials M1, M2 in FIG. 1 as well as in all further Figures are indicated with the aid of different shadings. The propeller shaft 14 is mounted in the drive housing 12 by means of a first shaft bearing 16 and a second shaft bearing 18.

The electric boat drive 10 further has a propeller shaft isolator 20, which is designed and configured to electrically isolate the propeller shaft 14 from the drive housing 12. The first metallic material M1 may include an aluminum alloy and the second metallic material M2 may include a steel alloy. A drive propeller 30 can be secured to an end of the propeller shaft 14 that protrudes from the drive housing 12.

A potential difference of approximately 1 volt may for example be present between the steel alloy and the aluminum alloy. As the propeller shaft isolator 20 electrically isolates the propeller shaft 14 from the drive housing 12, no electrochemical gradient can be formed even if the propeller shaft 14 as well as the drive housing 12 are submersed in an electrolyte, and galvanic corrosion can therefore not take place. As a result the metallic material M1 with the lower electric potential, in this case the aluminum alloy, is not exposed to galvanic corrosion.

According to the first embodiment of the electric boat drive 10, the first shaft bearing 16 and/or the second shaft bearing 18 may include an internal ring 162, 182 and an external ring 164, 184. The internal ring 162, 182 and/or the external ring 164, 184 of the first shaft bearing 16 and/or the second shaft bearing 18 may be designed as propeller shaft isolators 20. The material contact between the drive housing 12 and the propeller shaft 14 may be realized exclusively via the first shaft bearing 16 and the second shaft bearing 18.

According to the first variant of the first embodiment of the electric boat drive 10, the first shaft bearing 16 as well as the second shaft bearing 18 can each be designed as a slide bearing. The first shaft bearing 16 designed as a slide bearing may include an internal ring 162 as well as an external ring 164. The second shaft bearing 18 designed as a slide bearing may include an internal ring 182 as well as an external ring 184. According to the first variant of the first embodiment example of the electric boat drive 10 the external ring 164 of the first shaft bearing 16 and the external ring 184 of the second shaft bearing 18 may each be designed as a propeller shaft isolator 20. The propeller shaft 14 may correspondingly be electrically isolated from the drive housing 12 via the external rings 164, 184 of the first and second shaft bearings 16, 18, which are designed as propeller shaft isolators. The external rings 164, 184 designed as propeller shaft isolators 20 may for example comprise plastic, rubber, glass and/or a ceramic material.

Figure 2:
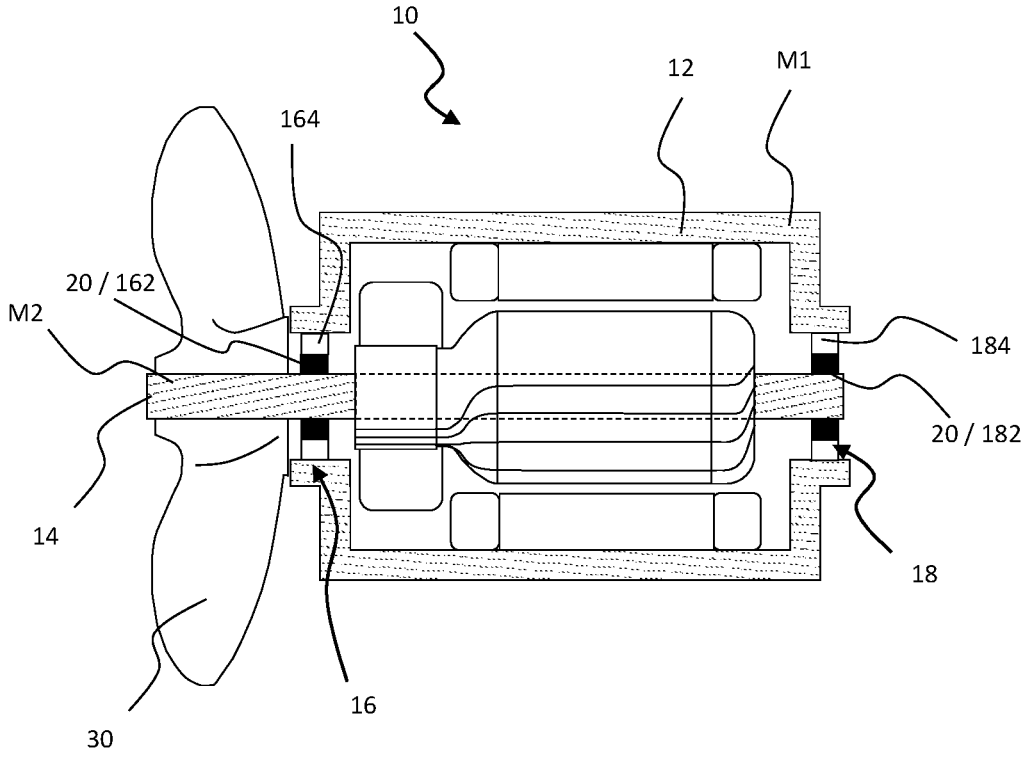
FIG. 2 illustrates a schematic cross-section drawing of an electric boat drive according to a second variant of a first embodiment.

A schematic cross-section drawing of an electric boat drive 10 according to a second variant of the first embodiment is shown in FIG. 2. According to the second variant of the first embodiment of the electric boat drive 10, the first shaft bearing 16 as well as the second shaft bearing 18 may each be designed as a slide bearing. The first shaft bearing 16 designed as a slide bearing may include an internal ring 162 as well as an external ring 164. The second shaft bearing 18 designed as a slide bearing may include an internal ring 182 as well as an external ring 174. According to the second variant of the first embodiment of the electric boat drive 10, the internal ring 162 of the first shaft bearing 16 and the internal ring 182 of the second shaft bearing 18 may each be designed as a propeller shaft isolator 20. The propeller shaft 14 may consequently be electrically isolated from the drive housing 16, 18 via the internal rings 162, 182 of the first and second shaft bearings 16, 18, which are designed as propeller shaft isolators. The internal rings 162, 182 designed as propeller shaft isolators 20 may for example comprise plastic, rubber, glass and/or ceramic material.

Figure 3:
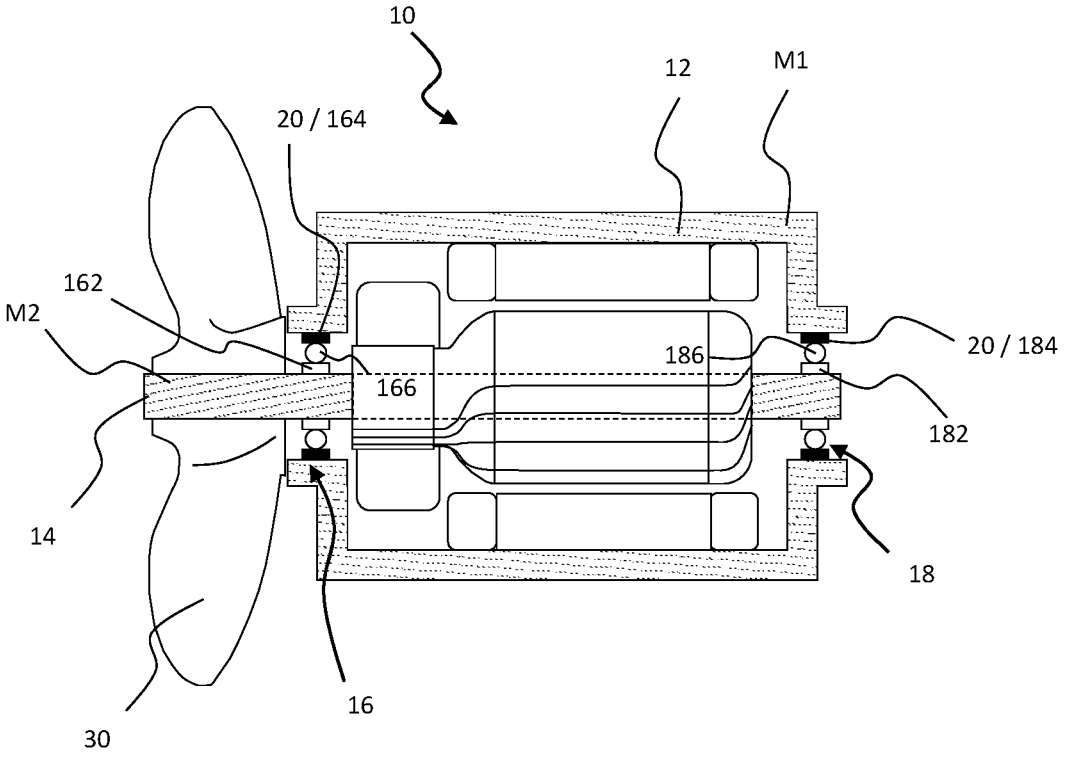
FIG. 3 illustrates a schematic cross-section drawing of an electric boat drive according to a third variant of a first embodiment.

A schematic cross-section drawing of an electric boat drive 10 according to a third variant of the first embodiment is shown in FIG. 3. According to the third variant of the first embodiment of the electric boat drive 10, the first shaft bearing 16 as well as the second shaft bearing 18 may each be designed as a roller bearing. The first shaft bearing 16 designed as a roller bearing may include an internal ring 162 as well as an external ring 164. The second shaft bearing 18 designed as a roller bearing may include an internal ring 182 as well as an external ring 184. According to the first variant of the first embodiment of the electric boat drive 10, the external ring 164 of the first shaft bearing 16 and the external ring 184 of the second shaft bearing 18 may each be designed as a propeller shaft isolator 20. The propeller shafts 14 may correspondingly each be electrically isolated from the drive housing 12 via the external rings 164, 184 of the first and second shaft bearings 16, 18, which are designed as a propeller shaft isolator. The external rings 164, 184 designed as propeller shaft isolators 20 may for example comprise plastic, rubber, glass and/or a ceramic material.

Figure 4:
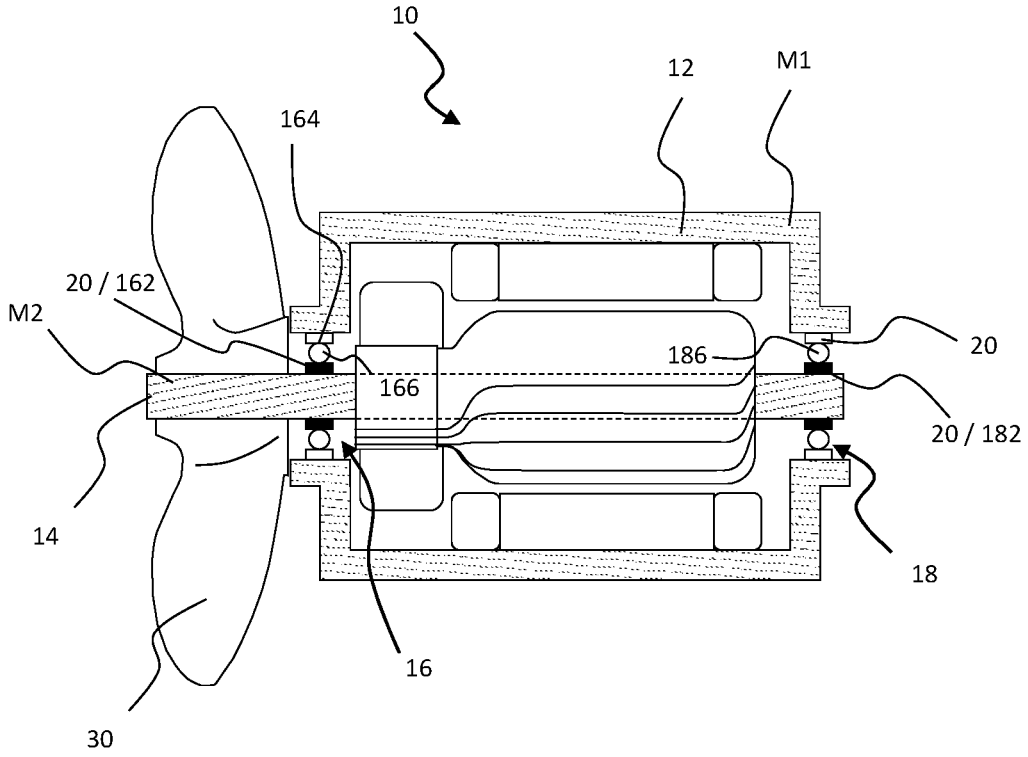
FIG. 4 illustrates a schematic cross-section drawing of an electric boat drive according to a fourth variant of a first embodiment.

A schematic cross-section drawing of an electric boat drive 10 according to a fourth variant of the first embodiment is shown in FIG. 4. According to the fourth variant of the first embodiment of the electric boat drive 10, the first shaft bearing 16 as well as the second shaft bearing 18 may each be designed as a roller bearing. The first shaft bearing 16 designed as a roller bearing may include an internal ring 162 as well as an external ring 164. The second shaft bearing 18 designed as a roller bearing may include an internal ring 182 as well as an external ring 184. According to the second variant of the first embodiment of the electric boat drive 10, the internal ring 162 of the first shaft bearing 16 and the internal ring 182 of the second shaft bearing 18 may each be designed as a propeller shaft isolator 20. The propeller shafts 14 may correspondingly be electrically isolated from the drive housing 12 via the external rings 162, 182 of the first and second shaft bearings 16, 18, which are designed as a propeller shaft isolator 20. The external rings 162, 182 designed as propeller shaft isolators 20 may for example comprise plastic, rubber, glass and/or a ceramic material.

Figure 5:
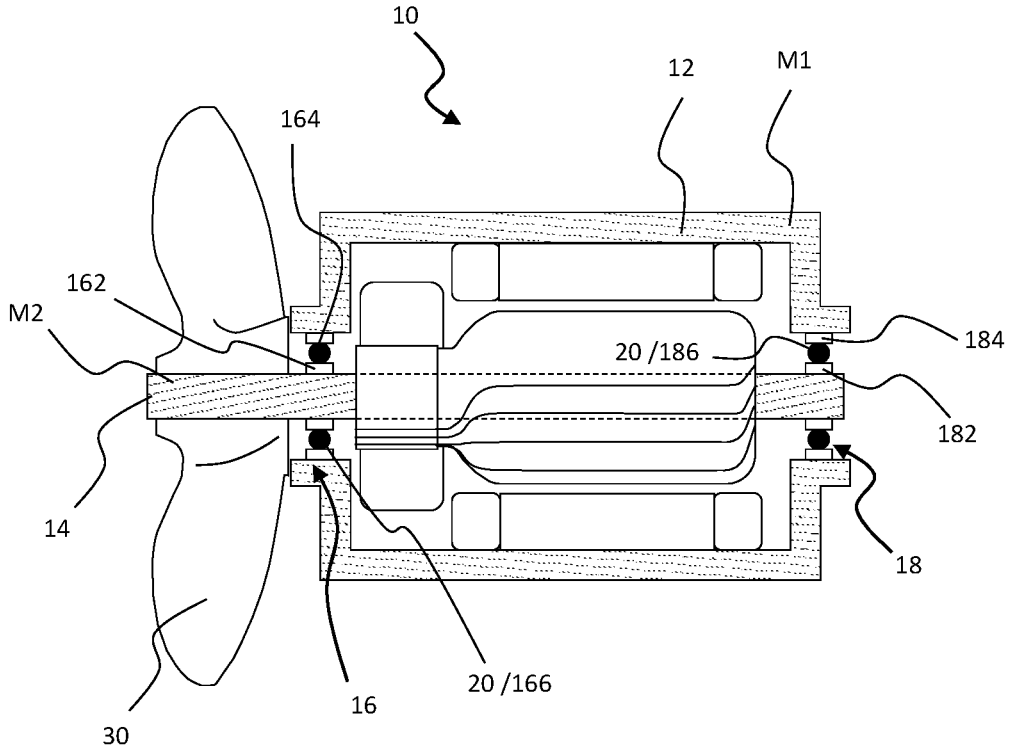
FIG. 5 illustrates a schematic cross-section drawing of an electric boat drive according to a second embodiment.

A schematic cross-section drawing of an electric boat drive 10 according to a second embodiment is shown in FIG. 5. According to the second embodiment of the electric boat drive 10, the first shaft bearing 16 as well as the second shaft bearing 18 may each be designed as a roller bearing. The first shaft bearing 16 designed as a roller bearing may include an internal ring 162 as well as an external ring 164. The second shaft bearing 18 designed as a roller bearing may include an internal ring 182 as well as an external ring 184. The first shaft bearing 16 may further include a first rolling element set 166 and/or the second shaft bearing 18 may include a second rolling element set 186. The first rolling element set 166 and/or the second rolling element set 186 may be designed as a propeller shaft isolator 20.

According to the second embodiment of the electric boat drive 10, the first rolling element set 166 of the first shaft bearing 16 and the second rolling element set 186 of the second shaft bearing 18 may each be designed as a propeller shaft isolator 20. The propeller shafts 14 may correspondingly each be electrically isolated from the drive housing 12 via the rolling element sets 166, 168 of the first and second shaft bearings 16, 18, which are designed as a propeller shaft isolator 20. The external rings 162, 182 designed as propeller shaft isolators 20 may for example comprise plastic, rubber, glass and/or a ceramic material.

Figure 6:
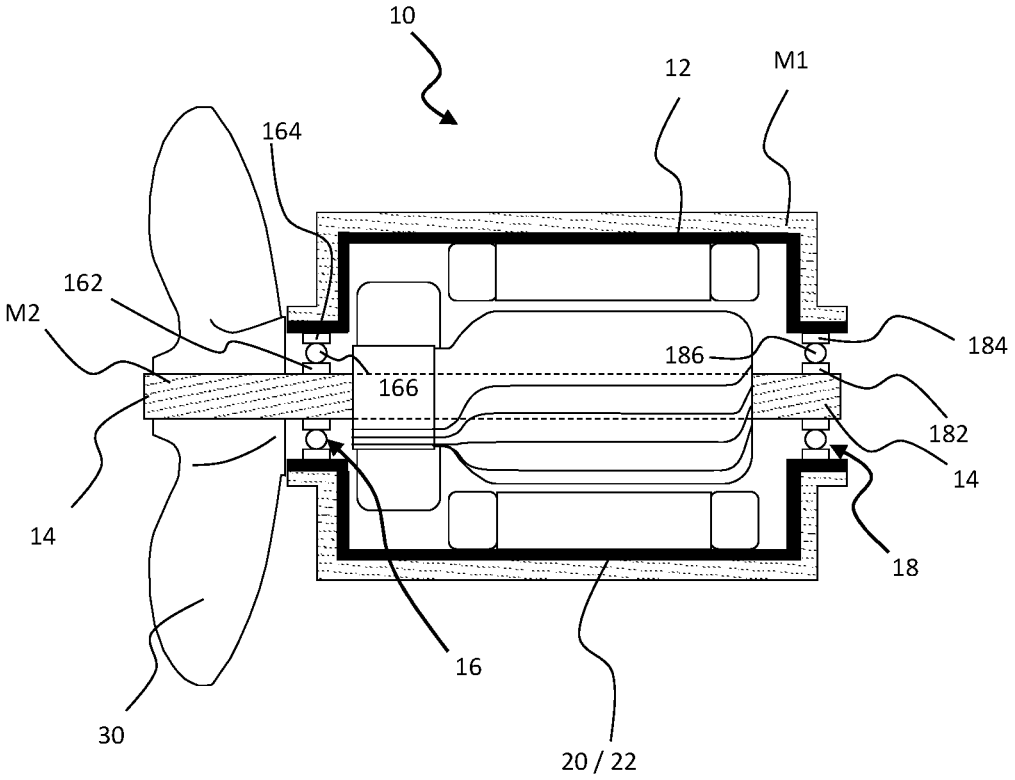
FIG. 6 illustrates a schematic cross-section drawing of an electric boat drive according to a third embodiment.

A schematic cross-section drawing of an electric boat drive 10 according to a third embodiment is shown in FIG. 6. According to the third embodiment of the electric boat drive 10, the first shaft bearing 16 as well as the second shaft bearing 18 may each be designed as a roller bearing. Despite this, the first shaft bearing 16 as well as the second shaft bearing 18 may each be designed as a slide bearing. According to the illustration shown in FIG. 6, the first shaft bearing 16 designed as a roller bearing may include an internal ring 162 as well as an external ring 164. The second shaft bearing 18 designed as roller bearing may include an internal ring 182 as well as an external ring 184. The first shaft bearing 16 may also include a first rolling element set 166 and the second shaft bearing 18 may include a second rolling element set 186.

According to the third embodiment of the electric boat drive, the propeller shaft isolator 20 may include a bearing sleeve 22 with a bearing sleeve interior 24. The bearing sleeve 22 may be designed and configured to be installed in the drive housing 12 and be designed and configured to receive at least one of the first shaft bearing 16 and the second shaft bearing 18 in the sleeve interior 24. The bearing sleeve 22 may for example include a bearing sleeve interior 24 with a variable cross-section. In addition, the bearing sleeve 22 may have an opening on both sides. The bearing sleeve 22 can further be designed along the housing interior of the drive housing 12 and substantially comprise all components of the electric boat drive 10 that are located in the interior of the drive housing 12. The fact that the propeller shaft isolator 20 includes a bearing sleeve 22, or is designed as a bearing sleeve 22, means that the propeller shaft 14 can be electrically isolated at its contact points with the drive housing 12. The propeller shaft 14 can correspondingly be electrically isolated from the drive housing 12 in the area of the first shaft bearing 16 and the second shaft bearing 18. The bearing sleeve 22 formed as a propeller shaft isolator 20 may for example comprise plastic, rubber, glass and/or a ceramic material.

The bearing sleeve 22 may also be designed by an isolating coating of the interior walls of the drive housing 12.

Figure 7:
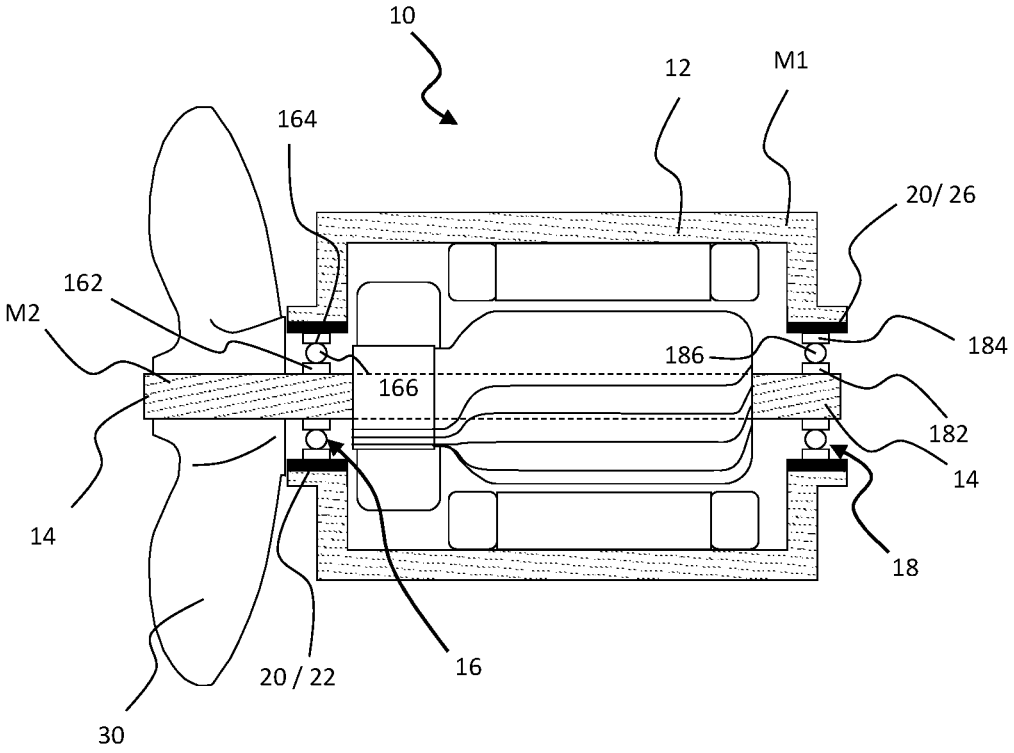
FIG. 7 illustrates a schematic cross-section drawing of an electric boat drive according to a fourth embodiment.

A schematic cross-section drawing of an electric boat drive 10 according to a fourth embodiment is shown in FIG. 7. According to the fourth embodiment of the electric boat drive 10, the first shaft bearing 16 as well as the second shaft bearing 18 may each be designed as a roller bearing. Despite this, the first shaft bearing 16 as well as the second shaft bearing 18 may each be designed as a slide bearing. According to the illustration shown in FIG. 7, the first shaft bearing 16 designed as a roller bearing may include an internal ring 162 as well as an external ring 164. The second shaft bearing 18 designed as roller bearing may include an internal ring 182 as well as an external ring 184. The first shaft bearing 16 may also include a first rolling element set 166 and the second shaft bearing 18 may include a second rolling element set 186.

According to the fourth embodiment of the electric boat drive, the propeller shaft isolator 20 may include a first bearing sleeve 22 with a first bearing sleeve interior 24 and a second bearing sleeve 26 with a second bearing sleeve interior 28. The first bearing sleeve 22 and the second bearing sleeve 26 may be designed and configured to be installed in the drive housing 12. The first shaft bearing 16 may be received in the first bearing sleeve interior 24 of the first bearing sleeve 22 and the second shaft bearing 18 may be received in the second bearing sleeve interior 28 of the second bearing sleeve.

The fact that the propeller shaft isolator 20 includes a first bearing sleeve 22 and a second bearing sleeve 26, or is designed as a first bearing sleeve 22 and a second bearing sleeve 26, means that the propeller shaft 14 can be electrically isolated at its contract points with the drive housing 12. The propeller shaft 14 can correspondingly be electrically isolated from the drive housing 12 in the area of the first shaft bearing 16 and the second shaft bearing 18. The bearing sleeve 22 formed as a propeller shaft isolator 20 may for example comprise plastic, rubber, glass and/or a ceramic material.

Figure 8:
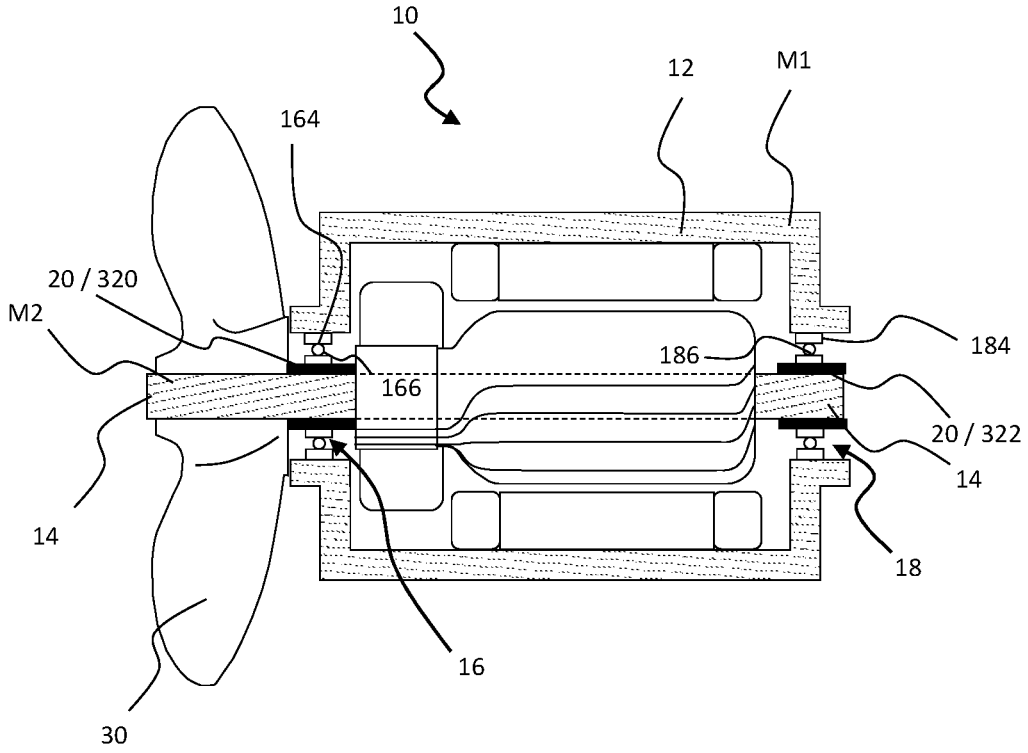
FIG. 8 illustrates a schematic cross-section drawing of an electric boat drive according to a fifth embodiment.

A schematic cross-section drawing of an electric boat drive 10 according to a fifth embodiment is shown in FIG. 8. According to the fifth embodiment of the electric boat drive 10, the first shaft bearing 16 as well as the second shaft bearing 18 may each be designed as a roller bearing. Despite this, the first shaft bearing 16 as well as the second shaft bearing 18 may each be designed as a slide bearing. According to the illustration shown in FIG. 8, the first shaft bearing 16 designed as a roller bearing may include an internal ring 162 as well as an external ring 164. The second shaft bearing 18 designed as roller bearing may include an internal ring 182 as well as an external ring 184. The first shaft bearing 16 may also include a first rolling element set 166 and the second shaft bearing 18 may include a second rolling element set 186.

According to the fifth embodiment of an electric boat drive 10, the propeller shaft isolator 20 may include a shaft sleeve 32, which is designed and configured to be rotationally rigidly arranged on the propeller shaft 14. The shaft sleeve 32 may include a first shaft sleeve 320, which is in contact with the first shaft bearing 16, and a second shaft sleeve 322, which is in contact with the second shaft bearing 18.

The fact that the propeller shaft isolator 20 includes a shaft sleeve 32, which is designed and configured to be rotationally rigidly arranged on the propeller shaft 14, means that the propeller shaft 14 may be electrically isolated at its contact points with the drive housing 12. The fact that the shaft sleeve 32 includes a first shaft sleeve 320 that is in contact with the first shaft bearing 16, and a second shaft sleeve 322 that is in contact with the second shaft bearing 18, means that the propeller shaft 14 can be electrically isolated at its contact points with the drive housing 12. The propeller shafts 14 can correspondingly be electrically isolated from the drive housing 12 via the in the area of the first shaft bearing 16 and the second shaft bearing 18. The shaft sleeve 32 designed as propeller shaft isolator 20 or the first shaft sleeve 320 designed as a propeller shaft isolator 20 and the second shaft sleeve 322 may for example be made of plastic, rubber, glass and/or a ceramic material.

Figure 9:
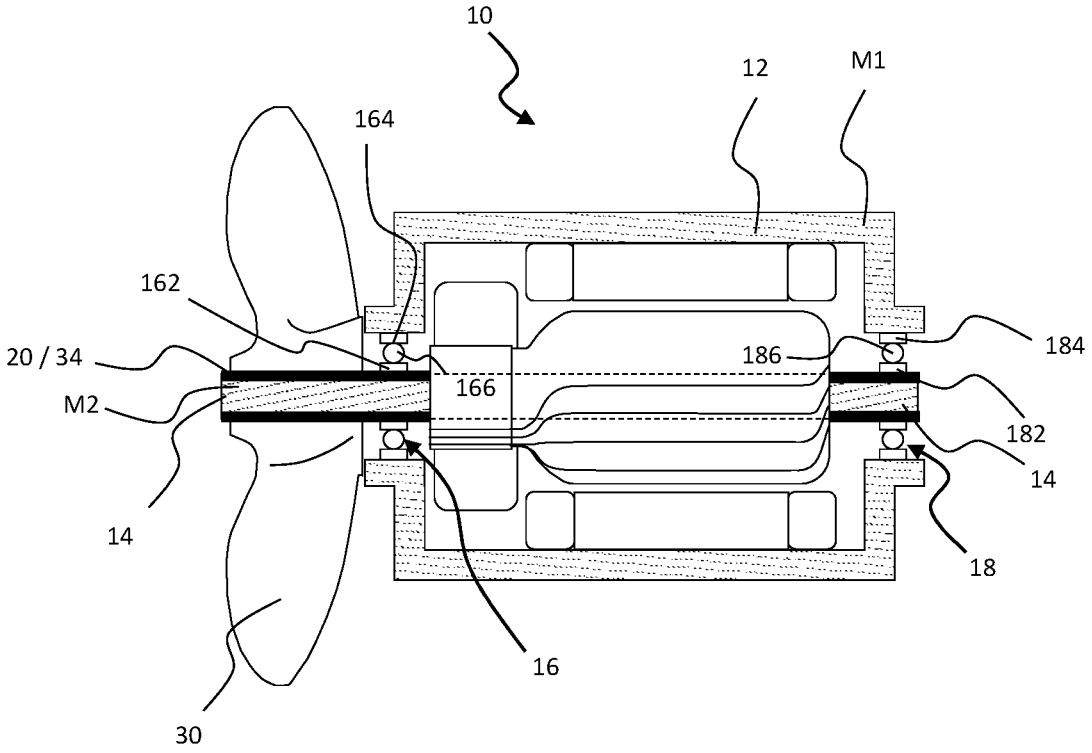
FIG. 9 illustrates a schematic cross-section drawing of an electric boat drive according to a sixth embodiment.

A schematic cross-section drawing of an electric boat drive 10 according to a sixth embodiment is shown in FIG. 9. According to the sixth embodiment example of the electric boat drive 10, the first shaft bearing 16 as well as the second shaft bearing 18 may each be designed as a roller bearing. Despite this, the first shaft bearing 16 as well as the second shaft bearing 18 may each be designed as a slide bearing. According to the illustration shown in FIG. 9, the first shaft bearing 16 designed as a roller bearing may include an internal ring 162 as well as an external ring 164. The second shaft bearing 18 designed as roller bearing may include an internal ring 182 as well as an external ring 184. The first shaft bearing 16 may also include a first rolling element set 166 and the second shaft bearing 18 may include a second rolling element set 186.

According to the sixth embodiment of an electric boat drive 10, the propeller shaft isolator 20 may be designed as a propeller shaft coating, wherein the propeller shaft coating may be produced by means of spraying, lacquering, vulcanization, adhesion, immersion belt lacquering and/or powder coating. The propeller shaft 14 may further comprise a drive propeller 30, wherein the drive propeller 30 may be directly fitted on the propeller shaft 14. The propeller shaft isolator 20 may be designed and equipped in such a way that the propeller shaft 14 is electrically isolated from the drive propeller 30.

The fact that the propeller shaft isolator 20 is designed as a propeller shaft coating means that the propeller shaft 14 may be electrically isolated at its contact points with the drive housing 12. The fact that the propeller shaft isolator 20, as a propeller shaft coating, is in contact with the first shaft bearing 16 and the second shaft bearing 18 in the area of the propeller shaft 14, means that the propeller shaft 14 may be electrically isolated at its contact points with the drive housing 12. The propeller shaft 14 may correspondingly be electrically isolated from the drive housing 12 in the area of the first shaft bearing 16 and the second shaft bearing 18. The propeller shaft coating designed as a propeller shaft isolator may for example be made of plastic, rubber, glass and/or a ceramic material.

Figure 10:
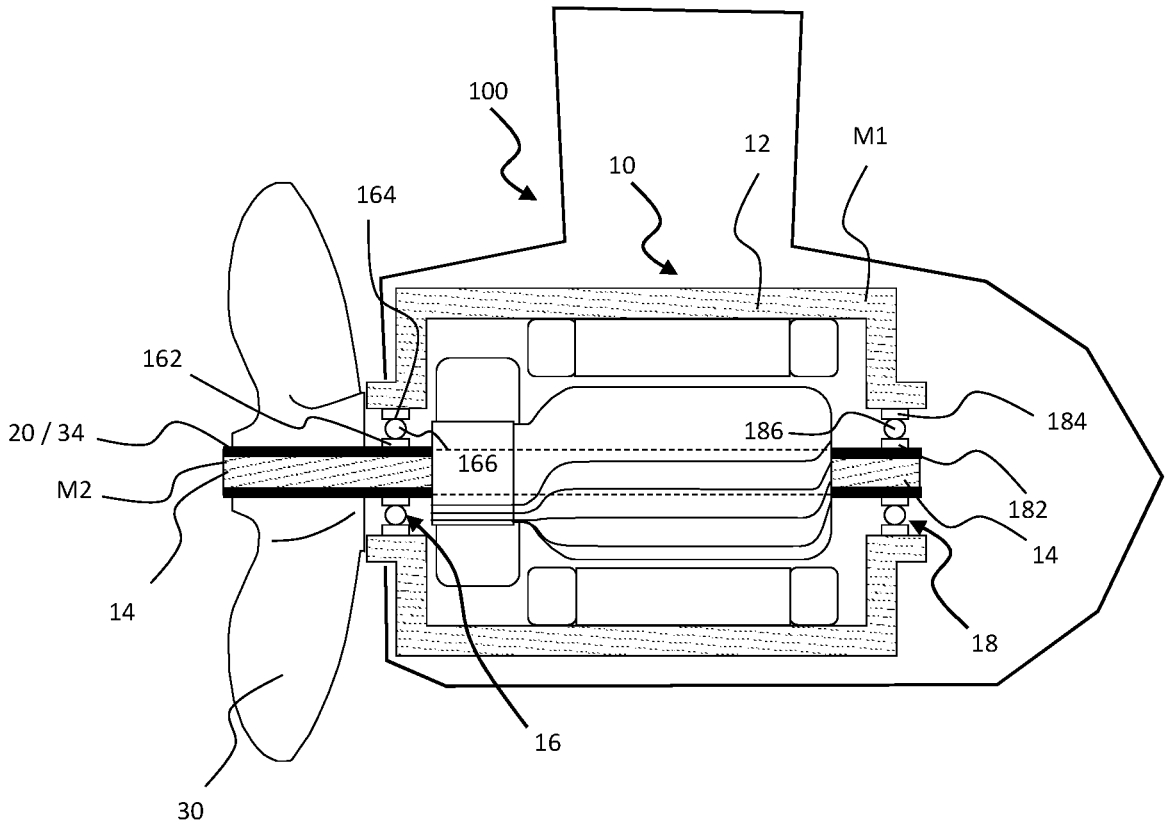
FIG. 10 illustrates a schematic cross-section drawing of an outboard engine.

A schematic cross-section drawing of an outboard engine 100 is shown in FIG. 10. The embodiment of the electric boat drive 10 shown in the outboard engine 100 equals that of the sixth embodiment.

The housing of the outboard engine 100 may partly or completely equal the drive housing 12 made from the first metallic material M1 described above. In other words, the drive housing 12 may equal the pylon of the outboard engine 100 in its outer contour.

A gearbox, the output of which forms the propeller shaft 14 or is connected with the same, may also be provided in all of embodiment examples shown in FIGS. 1 to 10. Individual components of the gearbox and/or the gearbox housing and/or a gearbox cage and/or a gear wheel and/or a worm gear and/or a bevel gear of the gearbox may accordingly be formed to isolate the propeller shaft 14 from the drive housing 12 and to provide propeller shaft isolation in this way. In this regard, the exemplary combinations provided are also described in the illustration of the invention and may also be used in combination with the embodiment examples described herewith.

Where applicable all individual features illustrated in the embodiment examples can be combined with and/or exchanged for each other without departing from the scope of the invention.

LIST OF REFERENCE NUMBERS

M1 first metallic material
M2 second metallic material
10 boat drive
12 drive housing
14 propeller shaft
16 first shaft bearing
18 second shaft bearing
20 propeller shaft isolator
22 first bearing sleeve
24 first bearing sleeve interior
26 second bearing sleeve
28 second bearing sleeve interior
30 drive propeller
32 shaft sleeve
34 propeller shaft coating
100 outboard engine
162 internal ring of first shaft bearing
164 external ring of first shaft bearing
166 rolling element set of second shaft bearing
182 internal ring of second shaft bearing
184 external ring of second shaft bearing
186 rolling element set of second shaft bearing
320 first shaft bearing sleeve
322 second shaft bearing sleeve

What is claimed:

1. A boat drive for driving a water vehicle, comprising:
a drive housing comprising a first metallic material;
a propeller shaft comprising from a second metallic material and being mounted in the drive housing;
a drive propeller; and
a propeller shaft isolator configured to electrically isolate the propeller shaft from the drive housing,
wherein the propeller shaft isolator is further configured to electrically isolate the propeller shaft from the drive propeller.

2. The boat drive according to claim 1, wherein the first metallic material includes aluminum and the second metallic material includes steel.

3. The boat drive according to claim 1, wherein the propeller shaft isolator comprises at least one of plastic, rubber, glass, a ceramic material and paper.

4. The boat drive according to claim 1, wherein the propeller shaft is mounted in the drive housing by a first shaft bearing and a second shaft bearing.

5. The boat drive according to claim 4, wherein:
at least one of the first shaft bearing and the second shaft bearing includes an internal ring and an external ring, and
at least one of the internal ring and the external ring is designed as the propeller shaft isolator.

6. The boat drive according to claim 4, wherein at least one the first shaft bearing and the second shaft bearing comprises a rolling element set that is designed as the propeller shaft isolator.

7. The boat drive according to claim 4, wherein:
the propeller shaft isolator includes a bearing sleeve with a bearing sleeve interior, and
the bearing sleeve is configured to be installed in the drive housing for receiving at least one of the first shaft bearing and the second shaft bearing in the sleeve interior.

8. The boat drive according to claim 4, wherein:
the propeller shaft isolator includes a first bearing sleeve with a first bearing sleeve interior and a second bearing sleeve with a second bearing sleeve interior,
the first shaft bearing is received in the first bearing sleeve interior of the first bearing sleeve, and
the second shaft bearing is received in the second bearing sleeve interior of the second bearing sleeve.

9. The boat drive according to claim 4, wherein the propeller shaft isolator includes a shaft sleeve that is configured to be rotationally rigidly arranged on the propeller shaft.

10. The boat drive according to claim 9, wherein the shaft sleeve includes a first shaft sleeve that is in contact with the first shaft bearing, and a second shaft sleeve that is in contact with the second shaft bearing.

11. The boat drive according to claim 1, wherein the propeller shaft isolator is formed as a propeller shaft coating produced by at least one of spraying, lacquering, vulcanization, adhesion, immersion belt lacquering and powder coating.

12. The boat drive according to claim 1, wherein the drive propeller is a foldable drive propeller secured directly to the propeller shaft).

13. The boat drive according to claim 1, further comprising a gearbox arranged in the drive housing, wherein at least one gearbox component is configured as an electrically isolating component.

14. An outboard engine for a water vehicle, comprising an electric boat drive according to claim 1.

15. The outboard engine according to claim 14, further comprising a pylon configured to receive the boat drive, wherein the drive housing partly or completely forms an outer contour of the pylon.

* * * * *